United States Patent [19]

Matsuo et al.

[11] Patent Number: 4,563,226

[45] Date of Patent: Jan. 7, 1986

[54] PROCESS FOR PRODUCING A GRAIN-ORIENTED ELECTRICAL STEEL SHEET

[75] Inventors: Munetsugu Matsuo; Fumio Matsumoto, both of Kawasaki; Tadashi Nakayama, Kitakyushu, all of Japan

[73] Assignee: Nippon Steel Corporation, Tokyo, Japan

[21] Appl. No.: 442,084

[22] Filed: Nov. 16, 1982

[30] Foreign Application Priority Data

Nov. 16, 1981 [JP] Japan ..... 56-182286

[51] Int. Cl.[4] ..... H01F 1/04

[52] U.S. Cl. ..... 148/111; 148/112

[58] Field of Search ..... 148/111, 112

[56] References Cited

U.S. PATENT DOCUMENTS

| | | | |
|---|---|---|---|
| 3,636,579 | 1/1972 | Sakakura et al. | 148/111 |
| 3,843,422 | 10/1974 | Henke | 148/111 |
| 3,933,024 | 1/1976 | Matsumoto et al. | 148/111 |
| 4,014,717 | 3/1977 | Barisoni et al. | 148/111 |
| 4,118,255 | 10/1978 | Barisoni et al. | 148/111 |
| 4,302,257 | 11/1981 | Matsumoto et al. | 148/111 |

FOREIGN PATENT DOCUMENTS

| | | |
|---|---|---|
| 47-39448 | 10/1972 | Japan . |
| 5413846 | 2/1975 | Japan . |

*Primary Examiner*—John P. Sheehan

*Attorney, Agent, or Firm*—Cushman, Darby & Cushman

[57] ABSTRACT

Conventionally, the silicon content of a grain-oriented electrical steel is approximately 3% at the maximum, since cold-rolling is difficult if the silicon content is high. Although conventional warm-rolling can occasionally mitigate the poor workability of a silicon steel having a high silicon content, it is impossible to control the texture of a cold-rolled strip and to completely prevent brittleness.

The present invention provides a novel rolling method in which, due to the heating of a steel strip prior to the carrying out of cold-rolling, a desirable texture can be formed and rupture of the cold-rolled strip can be prevented. The strip is heated to within a temperature range, in which both the minimum temperature which is at least 200° C. and at least equal to $T_L(°C.)=(x-3.0)^2\times 100$, x being the silicon content in weight percent, and the maximum temperature which temperature range being is not more than 400° C. and not more than $T_H(°C.)=-200\times\log(1/y)$, y being the strain rate (second$^{-1}$) during the cold rolling are determined so as to satisfy the temperature of the first cold rolling pass.

7 Claims, 2 Drawing Figures

PROCESS FOR PRODUCING A GRAIN-ORIENTED ELECTRICAL STEEL SHEET

Figure 1A:
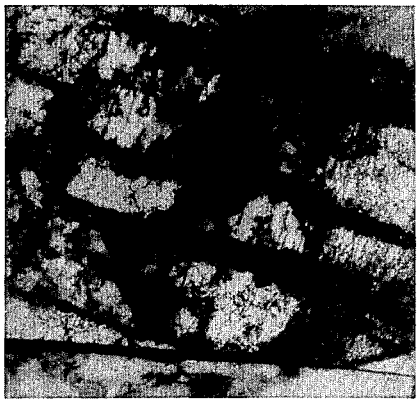

The present invention relates to a process for producing a grain-oriented electrical steel sheet having a high magnetic flux density and a low watt loss. More particularly, the present invention relates to a process in which the production conditions are optimized so that rupture of a steel strip due to embrittlement is avoided and excellent magnetic properties, i.e., a high magnetic flux density and a low watt loss, can be obtained.

Usually, grain-oriented electrical steel sheets are produced by a process which successively comprises steps of hot-rolling, annealing, cold-rolling, decarburization-annealing, and final high temperature-annealing.

The texture is the predominant factor which determines the magnetic properties of an electrical steel product. Particularly, when the texture of a silicon steel strip consist of preferred orientation of the [001] direction, i.e., the easiest direction of magnetization of iron crystal is aligned parallel to the rolling direction of the silicon steel strip, a grain-oriented electrical steel sheet having excellent magnetic properties can be produced. The texture of the grain-oriented electrical steel sheet is formed during secondary recrystallization, which takes place during final high temperature-annealing.

Secondary recrystallization is influenced by processing conditions of in the decarburization-annealing and cold-rolling. One of the fundamental factors responsible for the occurence of secondary recrystallization is the formation of the texture by slip deformation during the cold-rolling of steel strip. The mode of slip rotation of crystals determine the types and viability of potential secondary recrystallization-nuclei which is formed in the primary recrystallization texture due to the decarburization annealing.

The magnetic properties of silicon steel can be significantly improved by increasing the silicon content. An increase in the silicon content advantageously results in an increase in resistivity, which, in turn, results in a decrease in the eddy current and a decrease in watt loss. However, an increase in the silicon content is usually accompanied by embrittlement and difficulty of cold rolling operation.

Embrittlement of silicon steel during the cold-rolling process proceeds by cleavage fracture, which is due to twin formation within a relatively low temperature range, and blue brittleness, which is due to dynamic strain aging within a relatively high temperature range.

It is well known that cleavage fracture in silicon steel is very likely to occur when the silicon content is high and the deformation temperature is low. One could, therefore, easily conceive the idea of subjecting silicon steel to high-temperature rolling so as to prevent cleavage fracture.

Japanese Examined Patent Publication No. 47-39448/72 discloses a method of preventing brittleness in silicon steel used as an electrical sheet. In this method, alloying elements, such as Ca, Mg, Zr, Ti, V, and W, are added into the steel.

It is crucial in silicon steel used as an electrical sheet, especially, in silicon steel used as a grain-oriented electrical steel sheet, not only to improve the production adaptability but also to improve the magnetic properties.

As described above, since the texture of the steel strip is the predominant factor which determines the magnetic properties, consideration should be given to production steps which can advantageously control the texture rather than to improvement of mainly the production adaptability. In regard to this, even if conventional cold-rolling is replaced by so-called warm-rolling, which is carried out at a rather high temperature, a desirable texture cannot be formed.

This will be readily understood when the technical developments in electrical sheets up to the present time are considered. That is, when electrical sheets were first produced, the high quality electrical sheets were hot-rolled sheets containing approximately 4.5% silicon.

These hot-rolled electrical sheets have been gradually replaced by cold-rolled sheets in accordance with demands for improved magnetic properties. These demands have been satisfied mainly by controlling the texture of the steel strip. Additionally, the silicon content has been decreased from approximately 4.5% to approximately 3% at the highest, which is the silicon content of modern electrical sheets.

The background of the present invention is now explained in metallurgical terms. The operating slip planes of a silicon steel are varied depending upon the temperature in the cold rolling step for a final thickness. The number of crystal planes is limited at a low rolling temperature, therefore the plastic deformation in cold rolling cannot accomodated by slip deformation. Thus, twin deformation must be induced, and twin deformation can lead to cleavage fracture.

When the temperature in the rolling step is high, the number of operating slip planes of a silicon steel is increased, with the result that the mode of crystal orientation is undesirably changed. This leads to an undesirable change in the primary recrystallization texture, and causes incomplete secondary recrystallization or an undesirable change in the preffered orientation of secondary recrystallization. As a result, the magnetic properties of a grain-oriented electrical steel sheet are impaired, and accordingly, it is impossible to simply replace process of conventional cold-rolling with a warm-rolling.

It is known to control the texture of an extra mild steel sheet for deep drawing by carrying out warm-rolling. However, since the preferred orientation of an extra mild steel sheet is completely different from that of an electrical sheet, the known warm-rolling cannot at all be employed to control the texture of an electrical sheet, the purpose of controlling the texture being to enhance, especially, the magnetic flux density.

Incidentally, the warm-rolling of steel has been taboo because of the blue brittleness.

It is, therefore, an object of the present invention to provide a process with an excelbent combination of: a high magnetic flux density attained primarily by the formation of a desirable texture and secondarily by a high silicon content; a low watt loss attained by high silicon content; and, prevention of embrittlement due to cleavage fracture and blue brittleness due to the high silicon content.

In accordance with the objects of the present invention, there is provided a process for producing a grain-oriented electrical steel sheet having a high magnetic flux density and a low watt loss, wherein a silicon steel containing from 3.0% to 5.0% by weight of silicon, and not more than 0.085% by weight of carbon is successively hot-rolled, annealed within a temperature range of from 850° C. to 1200° C., preferably from 950° C. to 1200° C. followed by rapid cooling, cold-rolled at a heavy reduction of from 76 to 95%, preferably 81% to 95% until a final sheet thickness is obtained, decarburization-annealed, and final high temperature-annealed, characterized by heating the steel strip, prior to carrying out heavy cold-rolling, within a temperature range in which both the minimum temperature, which is at least 200° C. and at least equal to $T_L$(°C.)=$(x-3.0)^2\times 100$, x being the silicon content in weight percent, and the maximum temperature, which is not more than 400° C. and not more than $T_H$(°C.)=$200\times\log(1/y)$, y being the strain rate (second $^{-1}$) during cold-rolling, are determined so as to satisfy the temperature of the first cold-rolling pass.

The process according to the present invention successively comprises the steps of:

hot-rolling a silicon steel containing from 3.0% to 5.0% by weight of silicon, and not more than 0.085% by weight of carbon;

annealing the hot-rolled strip at a temperature of from 850° C. to 1200° C., preferably from 950° C. to 1200° C., followed by rapid cooling;

heating the annealed strip within a temperature range in which both the minimum temperature, which is at least 200° C. and at least equal to $T_L$(°C.)=$(x-3.0)^2\times 100$, x being the silicon content in weight percent, and the maximum temperature, which is not more than 400° C. and not more than $T_H$(°C.)=$200\times\log(1/y)$, y being the strain speed (second$^{-1}$) during the cold-rolling, are determined so as to satisfy the temperature of the first cold-rolling pass;

cold-rolling the heated strip ata heavy reduction of from 76 to 95%, preferably from 81% to 95%;

decarburization-annealing the cold-rolled strip; and final high-temperature-annealing the decarburization-annealed strip. It is now explained how the present inventors achieved the cold-rolling method of the present invention.

One can easily recognize that it is necessary, in order to form the texture, to appropriately control slip deformations mechanism during cold rolling. However, the occurrence of slip rotation of the crystals during rolling is merely of a theory and, thus, a concrete and reliable technique for forming the texture of a steel strip by which the magnetic flux density is enhanced cannot be developed based on it.

The present inventors recognized the necessity of investigating in detail the micro-structure of a cold-rolled strip and, therefore, extensively observed the micro-structure of such a strip with an electron microscope in respect to formation of the texture.

Figure 1B:
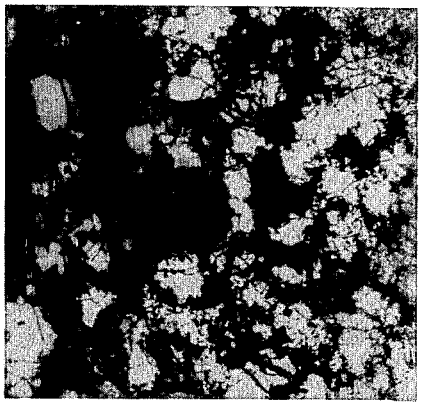

FIG. 1 (a) is an electron micrograph of the structure of a cold rolled silicon steel strip. This type of micro-structure results in a desirable orientation of the final product.

FIG. 1 (b) is an electron micrograph, similar to that of FIG. 1 (a). This type of micro-structure, however, results in an undesirable orientation of the final product.

As a result of the investigations, the present inventors discovered that in order to provide a grain-oriented electrical steel sheet with a desirable orientation, the dislocation groups which are generated during cold-rolling must be linearly arranged in the cold-rolled silicon steel sheet.

Such linear arrangement of the dislocation groups is shown FIG. 1 (a) at a magnification of 10,000. The cold-rolled strip of FIG. 1 (a) was produced by a process in which, first, a silicon steel containing 0.04% by weight of carbon, 4.0% by weight of silicon, and 0.03% by weight of acid-soluble aluminum was hot-rolled so as to obtain a 2.3 mm thick hot-rolled strip. Next, the hot-rolled strip was continuously annealed at 1150° C., followed by rapid cooling, and then was heated to 250° C. Subsequently, the hot-rolled strip having a temperature of 250° C. was subjected to the first cold-rolling pass at a strain rate of $8\times 10^{-3}$ second$^{-1}$. The resultant cold-rolled strip had dislocation groups which were generated due to cold-rolling and which were linearly arranged.

When the strip was subjected to the remaining cold-rolling passes at 250° C. and to final high temperature-annealing, the final product exhibited magnetic properties: $B_8=1.94$ (Wb/m$^2$) and $W_{17/50}=1.06$ (W/kg).

The same process used to produce the steel strip shown in FIG. 1 (a) was used to produce the steel strip shown in FIG. 1 (b) except that the steel strip was heated to a temperature of 450° C. instead of to 250° C. prior to cold rolling. The dislocation groups in the resultant cold-rolled strip were randomly arranged, and, as a result, desirable magnetic properties could not be obtained.

The present inventors extensively investigated the steel chemistry, heat treatment, and rolling method of a steel strip, in an attempt to determine which of these factors is reponsible for the formation of the micro-structure of the steel strip, such as the structure shown in FIG. 1 (a). As a result of the investigations, it was discovered that when a silicon steel is heated, prior to cold-rolling, to a temperature of from 200° C. to 400° C. so as to satisfactorily retain carbon in solid solution, the solute carbon impedes the movement of the dislocation groups during cold-rolling, with the result that a linear arrangement of the dislocation groups can be attained.

The heating temperature prior to the carrying out of cold-rolling must, therefore, be within the range of from 200° C. to 400° C., and the heating time should be at least 3 minutes so as to satisfactorily obtain solute carbon. If the heating temperature exceeds 400° C., the carbon is liable to precipitate in the form of carbides, which somewhat disrupt the linear arrangement of the dislocation groups.

If the movement of the dislocation groups is so drastically impeded that dynamic strain aging is totally induced, the steel embrittles, i.e., blue brittleness occurs, and the steel strip breaks in the cold-rolling step. Although it is known to control the heating temperature so as to prevent blue brittleness, the present inventors found that, in addition to the rolling temperature, the strain rate is an important factor in preventing blue brittleness. The present inventors also extensively investigated the steel chemistry and rolling conditions of a steel strip, in relation to which factors determine the critical conditions under which blue brittleness occurs. As a result of the present inventors' investigations, it was discovered that the maximum heating temperature $T_H$(°C.) of a steel strip must be $200\times\log(1/y)$, wherein y is the strain rate (second$^{-1}$). That is, even if the heating temperature is within a range of from 200° C. to 400° C., blue brittleness occurs at a temperature exceeding the maximum temperature $T_H$.

In addition, it was discovered that the minimum heating temperature should be determined based on the silicon content. Rolling becomes impossible at a temperature lower than the minimum heating temperature even if the heating temperature is within the range of from 200° C. to 400° C. Therefore, the minimum heating temperature $T_L$(°C.) must be $(x-3.0)^2\times100°$ C., wherein x is the silicon content in weight percent. When the silicon content exceeds 5%, a silicon steel embrittles at a temperature of 400° C. or less. In such a case, not only it is impossible to prevent rupture of the steel strip during cold-rolling, it is also impossible to control the texture of the steel strip so as to attain the effects of the present invention. The maximum silicon content must, therefore, be 5%. The formula $(x-3.0)^2\times100$ indicates that when the silicon content is 3.0% or more there is the danger that brittleness will occur during cold-rolling at room temperature. However, embrittlement can be prevented by setting the heating temperature at $T_L$ or more. The minimum silicon content can, be 3.0%. A preferable silicon content is from 3% to 4.5%. When the acid-soluble aluminum is used as the inhibitor, its content is preferably from 0.010% to 0.065% by weight.

Since it is possible to successfully carry out the first cold-rolling pass using a high silicon steel because the maximum and minimum heating temperatures prior to the carrying out of the first cold-rolling pass are limited, as described hereinabove, in the present invention, a desirable texture can be formed in the cold-rolling step and, simultaneously, rupture due to brittleness can be prevented. The second and subsequent cold-rolling passes can be carried out without any intentional heating of the steel strip since, at this time, linearly arranged dislocation groups which are generated when the first cold-rolling pass is carried out prevent cleavage fracture when the second and later cold-rolling passes are carried out. This means that natural cooling during the cold-rolling presents no problems. Furthermore, because of heat generated by plastic deformation, the finishing temperature of cold rolling is usually kept within a temperature of from 180° to 350° C.

Although the term "cold rolling" is used hereinabove, the cold-rolling of the present invention is essentially distinguished from conventional cold rolling in that, in the present invention, the rolling temperature in the first cold-rolling pass is controlled taking into consideration the silicon content and the strain rate. In addition, the working heat generated during conventional cold-rolling is essentially distinguished from the heat to which a silicon steel is subjected prior to the cold-rolling step because only the latter heat can create linearly arranged dislocation groups (FIG. 1 (a)) when the first cold-rolling pass is carried out.

In addition, the present invention is essentially distinguished from a known method disclosed in Japanese Examined Patent Publication No. 54-13846(79). In this known method, a silicon steel is held within a predetermined temperature range between the cold-rolling passes for the reasons described hereinabove. In the present invention, the reduction during cold-rolling is in the range of from 76 to 95%, preferably from 81% to 95% because such a heavy reduction contributes to the formation of a desirable texture. Cold-rolling can be carried out by means of a conventional reversing cold-rolling mill, and heating furnace, such as oil bath, is used to heat the steel strip prior to cold-rolling.

The hot-rolling step, the decarburization-annealing step, and the final high temperature-annealing step can be carried out in a conventional manner.

The present invention is now described by way of examples.

EXAMPLE 1

Silicon steels having the compositions shown in Table 1 were continuously cast into slabs and then the slabs were hot-rolled so as to produce 2.3 mm-thick hot-rolled strips. The hot-rolled strips were continuously annealed at 1150° C., followed by rapid cooling, and, subsequently cold-rolling, consisting of 10 cold-rolling passes of a reversing mill, was carried out.

In this process, the hot-rolled strips were subjected to one of the following treatments: direct cold-rolling; heating to 150° C. for 20 minutes; heating to 300° C. for 20 minutes; heating to 450° C. for 20 minutes. Then, the hot-rolled strips which were subjected to heating were directly cold-rolled. Therefore, the temperatures at the first cold-rolling pass was either room temperature, 150° C., 300° C., and 450° C., respectively. The strain rate in the first cold-rolling pass was $10^{-3}$ second$^{-1}$.

The resultant 0.27 mm-thick cold-rolled strips which were formed at a reduction of 87% were decarburization-annealed at 850° C. and then final high temperature-annealed at 1200° C.

TABLE 1

| Steels | C (wt %) | Si (wt %) | Mn (wt %) | S (wt %) | acid soluble Al (wt %) | N (wt %) |
|---|---|---|---|---|---|---|
| A | 0.05 | 2.85 | 0.09 | 0.03 | 0.03 | 0.007 |
| B | 0.05 | 3.32 | 0.09 | 0.03 | 0.03 | 0.007 |
| C | 0.06 | 3.88 | 0.09 | 0.03 | 0.03 | 0.007 |
| D | 0.06 | 4.55 | 0.08 | 0.03 | 0.03 | 0.006 |
| E | 0.06 | 5.10 | 0.08 | 0.02 | 0.03 | 0.007 |

The results of secondary recrystallization, the magnetic properties of the final products, and the occurence of embrittlement in the cold-rolling step are illustrated in Table 2.

TABLE 2

| Steels | Temperature at First Cold-Rolling Pass | Room Temperature (Comparative Example) | 150° C. | 300° C. | 450° C. |
|---|---|---|---|---|---|
| | A | Incomplete Secondary Recrystallization | $B_8$ = 1.85 $W_{17/50}$ = 1.15 | $B_8$ = 1.92 $W_{17/50}$ = 1.12 | Incomplete Secondary Recrystallization (Comparative Example) |
| | B | Incomplete Secondary Recrystallization | $B_8$ = 1.85 $W_{17/50}$ = 1.14 | $B_8$ = 1.92 $W_{17/50}$ = 1.08 | $B_8$ < 1.8 |
| | C | Rupture at First Cold-Rolling Pass | $B_8$ = 1.84 $W_{17/50}$ = 1.15 | $B_8$ = 1.91 $W_{17/50}$ = 1.06 | $B_8$ < 1.8 |
| | D | Rupture at First Cold-Rolling Pass | Rupture at Second Cold-Rolling Pass | B = 1.91 $W_{17/50}$ = 1.05 | Incomplete Secondary Recrystallization (Comparative |

TABLE 2-continued

| Steels | Temperature at First Cold-Rolling Pass | Room Temperature (Comparative Example) | 150° C. | 300° C. | 450° C. |
|---|---|---|---|---|---|
| | | | | | Example) |
| | E (Comparative Example) | Rupture at First Cold-Rolling Pass | Rupture at Second Cold-Rolling Pass | Rupture at Second Cold-Rolling Pass | Incomplete Secondary Recrystallization (Comparative Example) |

As Table 2 shows, secondary recrystallization was complete and no rupture due to embrittlement occurred during the cold-rolling except in the cases indicated.

In steel D, the minimum heating temperature $T_L$ was $(4.55-3.0)^2\times 100\div 240°$ C. The temperature in the first cold-rolling pass was 150° C. being too low to prevent embrittlement.

Since the maximum heating temperature $T_H$ was 600° C., the strain rate was therefore very low, i.e., $10^{-3}$ second$^{-1}$, with the result that the highest temperature of the first cold-rolling pass, i.e., 450° C., was considerably lower than the maximum heating temperature $T_H$, i.e., 600° C.

As is apparent from Table 2, appropriately by controlling the temperature in the first cold-rolling pass on the basis of the silicon content, excellent magnetic properties, i.e., $B_8<1.9$ Wb/m$^2$ and $W_{17/50}<1.10$ watt/kg, can be obtained without the occurrence of accidents during the cold-rolling.

EXAMPLE 2

The process of Example 1 was repeated by using steels B and D. However, the temperature of the first cold-rolling pass and the strain rate were varied, as shown in Table 3, so as to determine the occurrence of blue brittleness.

TABLE 3

| Temperature | Steel | Strain Rate (y) 20 sec$^{-1}$ | 200 sec$^{-1}$ | 2000 sec$^{-1}$ |
|---|---|---|---|---|
| 250° C. | B | Considerably Hardened | Rolling is Possible | Rolling is Possible |
| | D | Rolling is Difficult | | |
| 350° C. | B | Rupture at the 2nd Path | Rolling is Possible | Rolling is Possible |
| | D | | | |
| 450° C. | B | Rupture at the 1st Pass | Rolling is Difficult | Rolling is Possible |
| | D | | | |

What is claimed is:

1. A process for producing a grain-oriented electrical magnetic steel sheet having a high flux density and a low watt loss successively comprising the steps of:

hot rolling a silicon steel containing from 3.0% to 5.0% by weight of silicon, and not more than 0.085% by weight of carbon, annealing the hot-rolled strip at a temperature within the range of from 850° C. to 1200° C., followed by rapid cooling;

heating the annealed strip within a temperature range, in which both the minimum temperature, which is at least 200° C. and at least equal to $T_L(°C.)=(x-3.0)^2\times 100$, x being the silicon content in weight percent, and the maximum temperature which is not more than 400° C. and not more than $T_H(°C.)=200\times\log 1/y$ y being the strain rate (second$^{-1}$) during the cold-rolling;

heavily cold-rolling the heated strip having a temperature within said temperature range at a reduction of from 75% to 95%;

decarburization-annealing of the cold-rolled strip; and final high temperature-annealing of the decarburization-annealed strip.

2. Process according to claim 1, wherein the silicon content is from 3% to 4.5% by weight.

3. Process according to claim 1, wherein the second and subsequent cold-rolling passes are carried without any intentional heating of the steel strip.

4. A process according to claim 1, wherein said silicon steel contains from 0.010 to 0.065% by weight of acid-soluble aluminum.

5. A process according to claim 1, wherein said reduction is from 81 to 95%.

6. A process according to claim 1, wherein the annealing temperature is from 950° C. to 1200° C.

7. A process according to claim 1, wherein said silicon steel contains from 0.010 to 0.065% by weight of acid-soluble aluminum, said reduction is from 81 to 95%, and the annealing temperature is from 950° C. to 1200° C.

* * * * *